United States Patent [19]

Adams

[11] Patent Number: 5,020,673

[45] Date of Patent: Jun. 4, 1991

[54] CARRYING CASE FOR PERSONAL ITEMS

[76] Inventor: David R. Adams, 3735 Millcrest Rd., Salt Lake City, Utah 84109

[21] Appl. No.: 495,737

[22] Filed: Mar. 15, 1990

[51] Int. Cl.[5] ..... B65D 69/00

[52] U.S. Cl. ..... 206/581; 150/145; 150/112; 150/117

[58] Field of Search ..... 206/581, 38, 542, 472, 206/473, 474, 475; 150/106, 112, 117, 145, 144, 143, 147, 149, 152

[56] References Cited

U.S. PATENT DOCUMENTS

| | | | |
|---|---|---|---|
| 808,143 | 12/1905 | Dawson | 206/581 |
| 1,281,296 | 10/1918 | Coen | 206/581 |
| 1,359,319 | 11/1920 | Brenan | 150/135 X |
| 1,578,778 | 3/1926 | Thornhill | 206/581 |
| 1,722,507 | 7/1929 | Stanley | 206/581 |
| 1,947,604 | 2/1934 | Lewis | 206/581 |
| 2,168,073 | 8/1939 | Schnider | 206/581 X |
| 2,366,069 | 12/1944 | Stein | 150/143 X |
| 2,468,973 | 5/1949 | Hambrock | 150/112 |
| 2,511,533 | 6/1950 | Hyman | 150/143 X |
| 2,661,824 | 12/1953 | Nelson, Jr. . | |
| 2,667,199 | 1/1954 | Knee | 150/143 X |
| 2,727,549 | 12/1955 | Knee | 150/106 |
| 2,764,201 | 9/1956 | Whippo . | |
| 3,744,541 | 7/1973 | Brauhut | 150/145 |
| 3,769,741 | 11/1973 | Hessler et al. | 206/472 X |
| 4,126,168 | 11/1978 | Ganz et al. | 150/145 |
| 4,236,657 | 12/1980 | Brunton | 224/153 |
| 4,316,492 | 2/1982 | Plough et al. | 150/143 |
| 4,682,310 | 7/1987 | Lund et al. | 150/145 X |
| 4,752,008 | 6/1988 | Pratt | 206/579 |

*Primary Examiner*—William I. Price

*Attorney, Agent, or Firm*—Mallinckrodt & Mallinckrodt

[57] ABSTRACT

A carrying case for carrying personal items includes three hinged, generally planar, semi-rigid panel members having a plurality of pockets thereon to receive and hold items to be carried. The members may be folded to a folded or closed condition wherein the members overlap one another in side-by-side configuration to form a relatively compact case during transportation and storage or the members may be unfolded to an open condition to allow access to the members and to support the members in an upright position. In the open, upright position, the invention serves as a conveniently accessed dispenser for its contents. In the closed position, the invention conforms in general shape to its contents, thus taking up less space than a rigid case when not full, yet offering protection to the contents. The pockets of the case can include transparent windows so that a user can see what is in a pocket without having to open the pocket and remove the contents.

12 Claims, 2 Drawing Sheets

CARRYING CASE FOR PERSONAL ITEMS

BACKGROUND OF THE INVENTION

1. Field:

The present invention relates generally to portable bags or cases for transportation and storage of personal articles such as toiletry articles.

2. State of the Art:

Utility traveling cases and bags of various sizes, shapes and designs are well-known in the art. Some of these cases are designed to hold personal items such as toothpaste, toothbrushes, razors, shaving cream and feminine hygiene articles. For example, applicant is aware of the following patents, each of which disclose small, relatively stiff, carrying cases: Whippo, U.S. Pat. No. 2,764,201; Nelson, U.S. Pat. No. 2,661,824; and Stanley, U.S. Pat. No. 1,722,507.

More recently, a rectangular utility bag designed to fit into an athletic locker or under the seat of an airplane has been disclosed in Pratt, U.S. Pat. No. 4,752,008. The Pratt bag comprises a body portion including two spaced, rigid, rectangular frame members surrounded by fabric walls, and an outwardly swinging rectangular fabric door attached in hinge-like fashion along one elongate edge thereof to a sidewall edge of the body portion.

Because all of these prior art diclosures are substantially rigid, they are not as compatible to space economy during travel as might be desirable. For example, even if a traveller only requires a fraction of the space available in a generally rigid case of the prior art, the unused space still consumes a predetermined volume, whether contained within a larger carrying cases or carried separately.

Flexible utility cases for personal items are also known in the art. However, while such flexible cases solve the problem of space economy, by expanding and contracting according to the size, shape and amount of the contents, they offer little or no protection for the contents as the cases are completely flexible and the contents are usually held together in a single compartment. Because of this the contents are subject to breakage as the cases are subjected to the bumps and jolts that usually accompany travel. More fragile items, therefore, are advisably left at home or specially wrapped or prepared for travel.

SUMMARY OF THE INVENTION

According to the invention, a semi-rigid, foldable case having a plurality of item-holding pockets provided on semi-rigid panel members can be folded into a relatively compact case for travel and storage whereby the items are protected in their pockets, and unfolded to a position whereby the semi-rigid panel members of the case stand in an upright position for easy access to all of the pockets. The pockets preferably include a transparent portion or window which allows a user to easily see the contents of the pockets so he or she can easily select the pocket containing the item desired. Because the panels will stand upright when the case is in opened condition, the case provides easy storage and access to the items in the pockets so they can be removed for use and replaced after use. One of the panel members may include a mirror which is held in an upright, usable position by the upright panel.

The case of the invention includes three semi-rigid, generally planar panel members hinged together so that the members may be folded to overlap one another in side-by-side configuration to form a folded, relatively compact case for storage and transportation and so that the members can be unfolded to a configuration to allow access to all members and which will support and hold the members in an upright position on a surface. Pocket means are associated with one or more, and preferably each, of the members, for receiving and holding personal items and are properly oriented for access thereto when the members are in unfolded, upright position. The pockets may be provided with closure means such as flaps with snaps or Velcro to hold the contents therein. A handle may be provided to aid in carrying the case and means such as a strap and Velcro, may be provided for holding the case in folded condition.

In a prefered embodiment, the three planar members each comprise a sheet of semi-rigid material, such as styrene, surrounded by fabric onto which the pockets are sewn. This semi-rigid material is flexible enough to generally conform to the contents of the case. If the pockets are full, the planar members may bend as needed to wrap around said pockets, but if the pockets are substantially empty, or not overly full, the planar members remain substantially planar, thus forming a generally planar case. These semi-rigid planar members also act as a shield to protect the contents from any number of mishaps. As a result, even fragile items may be placed in the case and taken when travelling without special wrapping or packaging. Furthermore, the semi-rigid planar members allow the case to stand upright on a surface when unfolded into an open, three-sided configuration. This advantage provides for convenient access to the contents of the case and convenient use of the case for storage of the items between uses.

THE DRAWINGS

In the accompanying drawings, which show the best mode presently contemplated for carrying out the invention:

FIG. 1, is a front perspective view of an expandable case of the invention, shown in the unfolded, open, upright position;

FIG. 2, a front perspective view of the case of FIG. 1, shown in the folded or closed position;

FIG. 3, a vertical section taken on the lines 3—3 of FIG. 1;

FIG. 4, a top plan view of the case in the folded condition shown in FIG. 2; and FIG. 5, a top plan view similar to that of FIG. 4, but showing the case more fully packed.

DETAILED DESCRIPTION OF THE ILLUSTRATED EMBODIMENT

Figure 1:
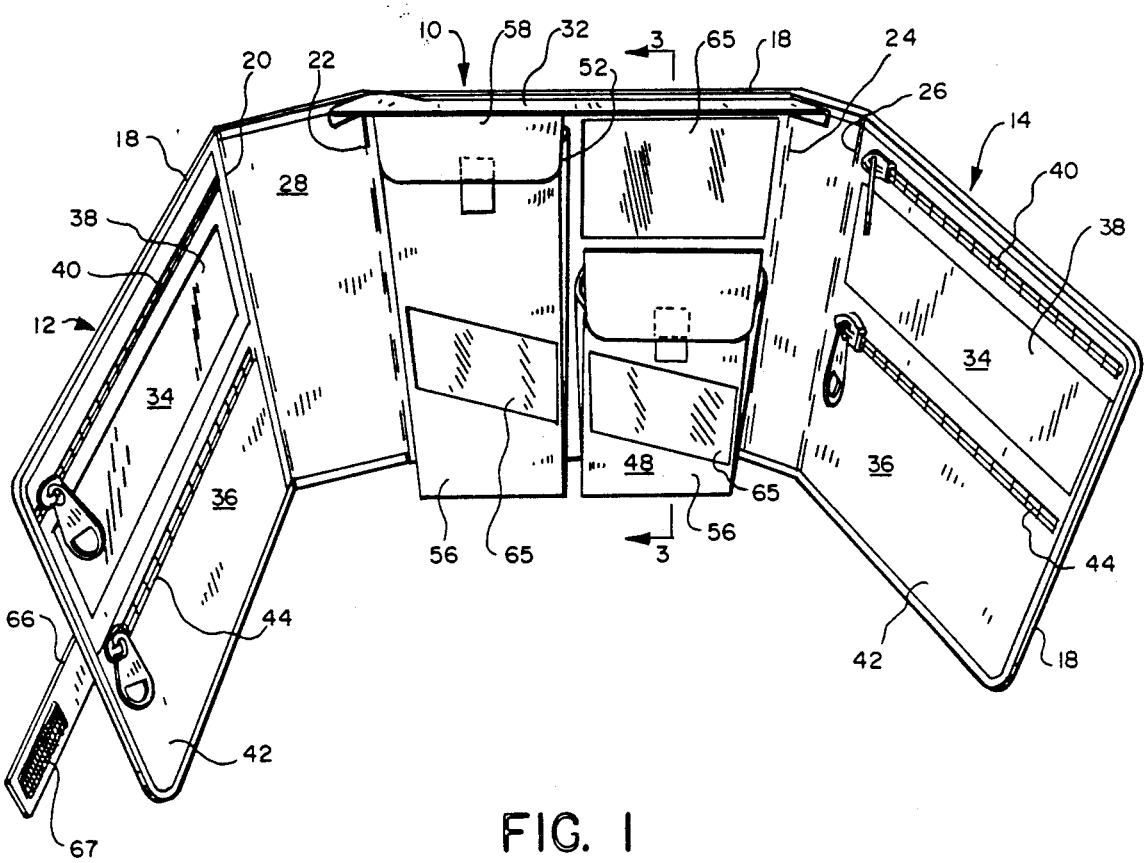

A presently preferred embodiment of the invention includes a central planar panel member 10 and two outer planar panel members 12 and 14. Each planar member 10, 12 and 14 comprises a thin substantially square, semi-rigid sheet of a plastic material, such as styrene, as shown as 15, FIG. 3, for the central member 10. The plastic sheet material is tightly covered on both broad faces with fabric 16. However, for ease of illustration, the fabric 16 is shown spaced from plastic 15 in FIG. 3. The edges of fabric 16 are sewn together about the circumference of the plastic sheet as at seam 17 and a reinforcing fabric bias tape 18 covers the edges of fabric 16 to improve the appearance and reinforces the seam. In some cases, it may be desireable to actually extend the plastic sheet through the seam 17 so that the fabric is actually sewn to the edges of the plastic sheet.

The outer members 12 and 14 are hingedly connected to opposite ends of the central member 10. The hinge connections may be conveniently formed by extending the fabric covering the plastic sheets between the members. Thus, the fabric 16 covering the plastic sheets may be a continuous sheet extending from one edge of the device to the other. Linear double seams 20, 22, 24 and 26, define the adjacent edges of planar members 12, 10 and 14, with the fabric between the planar member edges forming the hinge connections between the members. Thus, the fabric between seams 20 and 22 forms the hinge connection between members 10 and 12, and the fabric between seams 24 and 26 forms the hinge connection between members 10 and 14.

Figure 2:
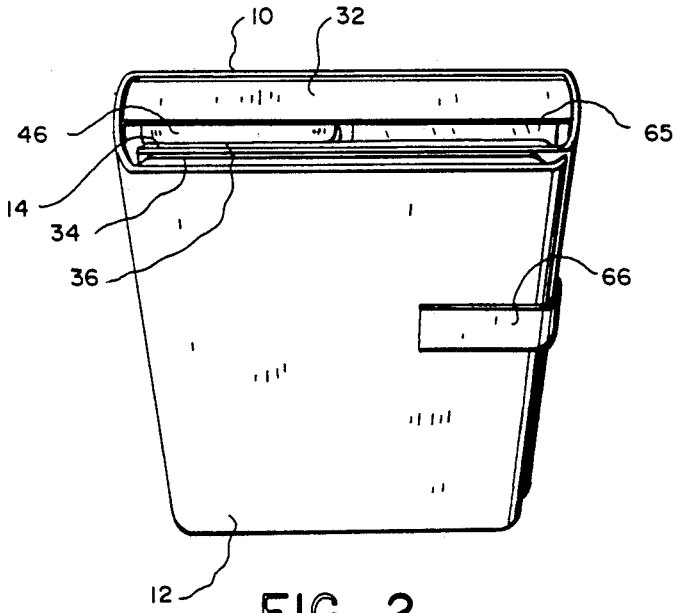
Figure 4:
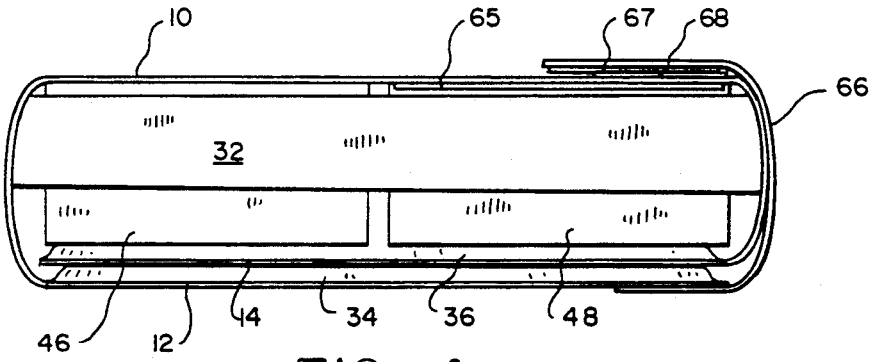
Figure 5:
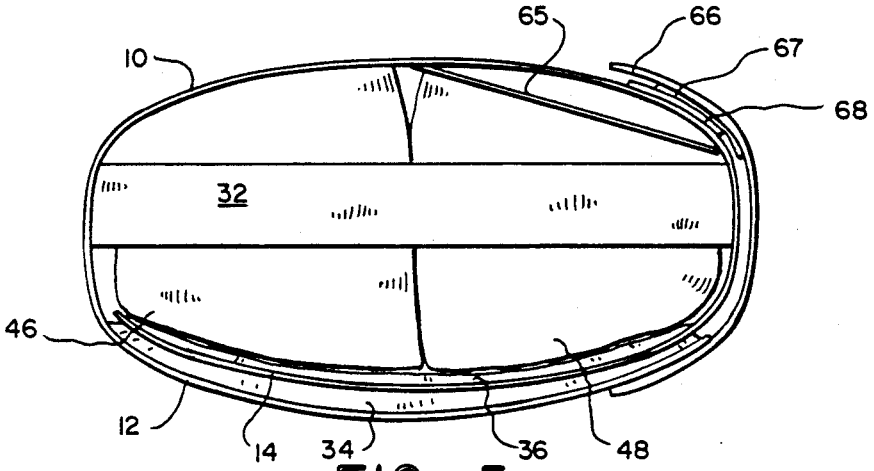

The distance between seams 20 and 22, i.e., the width of the hinge connection between members 10 and 12, is greater than that between seams 24 and 26, i.e. the width of the hinge connection between members 10 and 14. This facilitates the folding of the invention into the closed position shown in FIGS. 2, 4, and 5, wherein the members are folded to overlap one another in side-by-side configuration. In folding the case, outer planar member 14 is first folded over central member 10. Then, outer member 12 is folded over both members 10 and 14, as shown.

A strap handle 32 is sewn at one end to the top of fabric region 28 and at the opposing end to the top of fabric region 30, thus spanning the top portion of central planar member 10, as shown. The handle 32 provides not only a convenient method of carrying the case, but also tends to prevent the extension of outer planar members 12 and 14 into a coplanar relationship with central planar member 10. A coplanar relationship of the three planar members 10, 12 and 14 in the open position is preferrably avoided since one of the main objects of the invention is to provide a portable case capable of standing upright on a flat horizontal surface. This is accomplished by opening each outer planar member 12 and 14 approximately 135 degrees from the closed position, as shown in FIG. 1, and standing the open case upright. The semi-rigid plastic material in the planar members 10, 12 and 14 has sufficient structural integrity to maintain the case, and each member thereof, in the upright position.

A variety of pockets are attached to the inside broad faces of the planar members 10, 12 and 14. The illustrated arrangement of pockets and pocket type are identical on outer planar members 12 and 14, however, various different arrangements of pockets may be used on each member. As shown in FIG. 1, each of the members 12 and 14 includes two approximately equal rectangular pockets 34 and 36. Pockets 34 are formed by flat pieces of clear plastic 38 sewn at their edges to the inside broad faces of outer members 12 and 14, with zippers 40 located along the top edge of each pocket to provide an opening into each pocket 34, as well as a means for closing the pockets so that items stored therein are held securely in the pockets. Pockets 36 are directly below pockets 34 and are identical thereto except that pockets 36 comprise a flat section of fabric 42 instead of transparent plastic. Zippers 44 provide ingress and egress to pocket 36 and are similar to zippers 40.

Figure 3:
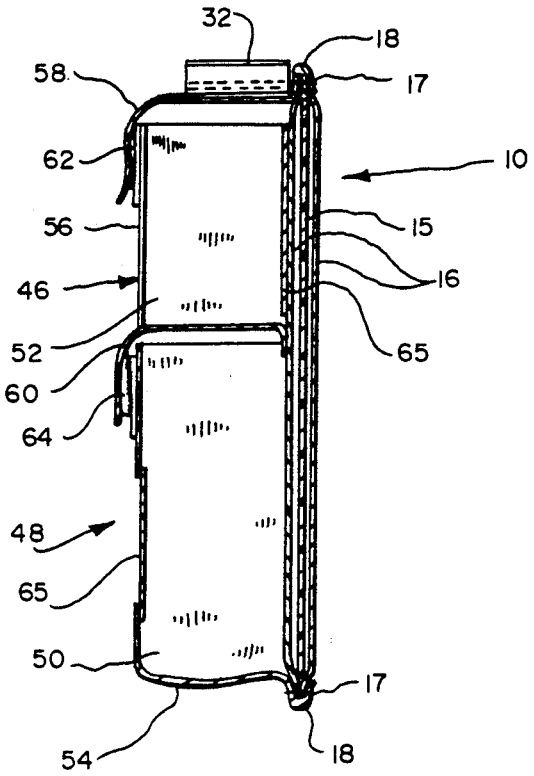

Central planar member 10 has expandable pockets 46 and 48 sewn onto its inside broad face, as shown in FIGS. 1 and 3. Each pocket 46 and 48 comprises two side sections 50 and 52, a bottom section 54, and a front section 56. Both pockets 46 and 48 are shown to be rectangular in shape, pocket 48 being somewhat shorter than pocket 46. Pocket 46 has a fabric closure flap 58 and pocket 48 has a fabric closure flap 60, each flap being rectangular in shape and sewn along one edge to central planar member 10 just above the open top end of each respective pocket 46 and 48. The flaps 58 and 60 extend over and beyond the open top end of pockets 46 and 48, respectively, to form closures therefor. Velcro strips 62 and 64 allow for temporary attachment of flaps 58 and 60, respectively, to the front section 56 of pockets 46 and 48, to close such pockets. A mirror 65 is attached to the inside broad face of central planar member 10 directly above smaller pocket 48.

As shown in FIG. 1, a piece of clear plastic 65 is provided in front section 56 of pockets 46 and 48. This provides a user the advantage of being able to examine the contents of pockets 46 or 48 without opening flaps 58 or 60, and removing the contents of the pocket to locate a certain item that may or may not be contained therein.

One end of a strap 66, provided for securing the case in folded condition, is secured, such as by sewing to the outside of planar member 12 such that most of the strap 66 extends laterally beyond the outer end of member 12. A piece of Velcro 67 is secured to the inside surface of strap 66 and is positioned to mate with a mating strip of Velcro 68 secured to the outside surface of member 10. Thus, when the case is folded to a "closed" position shown in FIGS. 2, 4, and 5, strap 66 may be wrapped around the perimeter of the case until the Velcro strips 67 and 68 come into contact with each other and mate to secure the case in the folded condition.

While a specific construction of the members has been shown and a specific pocket arrangement has been shown, various constructions and materials can be used to construct the members and to hinge the members together, and various pocket arrangements can be used. The provision of the mirror is not necessary, but is handy, and since the members are held in an upright position, the mirror is maintained in an upright, usable position by the member to which it is attached leaving both hands of a user free for grooming purposes.

The case will normally be carried in a larger suitcase or garment bag and removed for use when access to the items carried therein is desired. It will not usually be carried as a separate item of luggage.

Further, while the device has been described specifically as carrying personal items such as toiletry items, the case could be used for various other items.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A carrying case for personal items comprising:

a generally planar, semi-rigid central member including a sheet of stiffening plastic and having a pair of opposing ends;

two generally planar, semi-rigid outer members, each including a sheet of stiffening plastic, and each hingedly connected to an opposing end of said central member so that said members may be folded to overlap one another in side-by-side configuration to form a folded, relatively compact case during transportation and storage and so that said outer members can be unfolded to extend angularly outwardly from the ends of the central member to allow access to all members and support said members in an upright position on a surface; and pocket means associated with said members for receiving and holding personal items, said pocket means being properly oriented for access thereto when said members are in upright position.

2. A carrying case for personal items according to claim 1, wherein said sheet of plastic is styrene.

3. A carrying case for personal items according to claim 1, additionally including handle means for carrying the case when in folded condition.

4. A carrying case for personal items according to claim 3, wherein said handle means includes an elongated strap secured between the opposing ends of the central member.

5. A carrying case for personal items according to claim 1, wherein said pocket means includes a plurality of pockets secured to at least one of the generally planar, semi-rigid members.

6. A carrying case for personal items according to claim 5, wherein at least one of said pockets is expandable to allow storage of a greater volume of contents.

7. A carrying case for personal items according to claim 6, wherein at least one of pockets further comprises transparent material visually exposing the contents thereof.

8. A carrying case for personal items according to claim 5, wherein said pockets include closure means.

9. A carrying case for personal items according to claim 8, wherein said closure means is snap fasteners.

10. A carrying case for personal items according to claim 8, wherein said closure means is Velcro.

11. A carrying case for personal items according to claim 1, further comprising fastening means to hold the case in folded condition.

12. A carrying case for personal items according to claim 11, wherein said fastening means includes a Velcro fastener.

* * * * *